US008070025B1

(12) United States Patent
Nelson

(10) Patent No.: US 8,070,025 B1
(45) Date of Patent: Dec. 6, 2011

(54) JEWELRY STORAGE HANGER

(76) Inventor: Chanitya Janet Nelson, Los Angeles, CA (US)

( * ) Notice: Subject to any disclaimer, the term of this patent is extended or adjusted under 35 U.S.C. 154(b) by 367 days.

(21) Appl. No.: 12/459,216

(22) Filed: Jun. 29, 2009

Related U.S. Application Data

(63) Continuation of application No. 11/897,199, filed on Aug. 29, 2007, now abandoned.

(51) Int. Cl.
*A41D 27/22* (2006.01)

(52) U.S. Cl. ..... 223/88; 211/85.2

(58) Field of Classification Search ..... 223/85, 223/88, 92, DIG. 1; 211/85.2
See application file for complete search history.

(56) References Cited

U.S. PATENT DOCUMENTS

| | | | | |
|---|---|---|---|---|
| 1,982,166 | A | 11/1934 | Hultquist | |
| D167,836 | S | 6/1952 | Kandarian | |
| 3,081,881 | A | 3/1963 | Seeger | |
| 3,790,044 | A | 2/1974 | Verdile | |
| D243,055 | S | 1/1977 | Blumberg | |
| D247,084 | S | 1/1978 | De Mascole et al. | |
| 4,401,219 | A | 8/1983 | Mink | |
| 4,620,651 | A | 11/1986 | Spies | |
| 4,854,656 | A | 8/1989 | O'Keefe | |
| 4,966,287 | A | 10/1990 | Snyder | |
| 5,295,587 | A | 3/1994 | Downes et al. | |
| 5,427,230 | A | 6/1995 | Mattox | |
| 5,509,588 | A | 4/1996 | Kimball | |
| 5,526,968 | A | 6/1996 | Larson | |
| 5,551,772 | A * | 9/1996 | Keffer | 211/85.2 |
| 6,161,686 | A * | 12/2000 | Simon et al. | 223/85 |
| 6,398,086 | B1 | 6/2002 | Bennett | |
| 6,450,595 | B1 * | 9/2002 | Simon et al. | 223/85 |
| 6,776,463 | B2 | 8/2004 | Simon et al. | |
| 6,808,064 | B1 | 10/2004 | Fanning | |
| 7,377,409 | B1 | 5/2008 | Brown | |
| 7,389,868 | B2 * | 6/2008 | Lewand et al. | 211/85.2 |
| 2004/0016670 | A1 | 1/2004 | Lewand et al. | |

* cited by examiner

*Primary Examiner* — Nathan Durham
(74) *Attorney, Agent, or Firm* — Berggren Law Offices, LLC; William R Berggren

(57) ABSTRACT

A jewelry storage apparatus is disclosed that combine a traditional jewelry storage box with a hanger to utilize vertical space in a closet. One embodiment is an apparatus for storing jewelry that comprises a hanger and a storage structure affixed to the hanger where the storage structure comprises a ring structure with a base and compression slits for holding rings in a display mode, a bracelet structure for suspending bracelets, an earring structure for displaying earrings, and a necklace structure for hanging necklaces. The apparatus is suitable for storing in a display-mode a large amount of various types of jewelry including rings, necklaces, earrings and bracelets in both a scratch-free mode and a tangle-free manner.

17 Claims, 3 Drawing Sheets

JEWELRY STORAGE HANGER

CROSS-REFERENCE TO RELATED REFERENCES

This application is a continuation of application Ser. No. 11/897,199, filed Aug. 29, 2007 now abandoned.

FIELD OF THE INVENTION

This invention relates to a hanging apparatus for storing jewelry.

BACKGROUND OF THE INVENTION

There is a need for an apparatus to store larger quantities and more varied forms of jewelry in an easily displayed and a space saving manner off of countertops and floors, without getting jewelry pieces tangled up.

Typically jewelry is stored in boxes and organizers. However, boxes and organizers have limited space that results in jewelry often being crowded when it is stored. Crowding causes the tangling of items especially necklaces. Additionally, existing jewelry boxes and organizers are very limited in the amount of jewelry they can hold requiring a person to purchase additional boxes. The drawback is twofold, spending more money and taking up more counter or floor space. Furthermore, rummaging through many drawers in a jewelry box is inconvenient.

The need to store more jewelry has increased. In recent years jewelry makers have increased the color, style and choices available so that women can more closely and uniquely match jewelry with their outfits and personalities. As a result, the public has been buying more than ever before. The jewelry "box" and armoires that have been the standard of containing these items in the home are causing a greater level of irritation as pieces of jewelry become more tangles and scratched and the number of boxes to search multiplies. Earring and necklace sets more often become separated.

Vertical storage devices have been known but are inadequate. These devices do not permit display of a wide enough variety of types of jewelry. Often the devices are able to display necklaces in an untangled hanging mode and bracelets suspended to avoid scratching. However, none permit easy display of rings in compression slits as seen in jewelry store boxes. Thus, sets of rings, bracelets, earrings and necklaces for various outfits are difficult to find or assemble.

There is still an increasing need for a jewelry organizer which holds large amounts of a wide array of different types of jewelry in a limited space, keeping all pieces tangle free while displaying them in open view.

SUMMARY OF THE INVENTION

My invention fills these needs by combining the traditional box with a hanger utilizing the vertical space in a closet. Specifically I have invented a jewelry storage hanger. One embodiment of my invention is an apparatus for storing jewelry comprising a hanger and a storage structure affixed to the hanger where the apparatus is suitable for storing in a display-mode various types of jewelry including rings, necklaces, earrings and bracelets. The storage structure comprises a ring structure with compression slits for holding rings in a display mode, a bracelet structure for suspending bracelets in a scratch-fee manner, an earring structure for displaying hook and post earrings in a scratch-free manner, and a necklace structure for hanging necklaces in a tangle-free and scratch free manner.

Another embodiment is a jewelry storage apparatus comprising a hanger and a jewelry storage structure affixed to the hanger. The hanger includes a hook midway between two arms that extend in opposite directions and angle downward, each arm having an end. The jewelry storage structure affixed to each end comprises a frame that has two sides, a top and a bottom, the frame top has a top-side and an under-side and the frame bottom has a top-side. The structure also comprises a ring structure, a bracelet structure, an earring structure and a necklace structure, all affixed to the frame. The ring structure is a box structure with sides affixed to the hanger ends, a base fastened to the top-side of the top of the frame, and compression slits along a top surface for holding rings in a display mode. The bracelet structure for suspending bracelets in a scratch free manner comprises a protrusion pivotally connected to and extending from a side of the frame. The earring structure comprises two structures for displaying hook and post earrings in a scratch-free manner. One of the earring structures comprise a box having a base, two ends where each end is affixed to a side of the frame, two sides where each side has groves perpendicular to the base, parallel to each other, in the surfaces of the sides that face each other, paired so that each grove from one side is opposite a matching groove from the other side, and a plurality of removable, repositionable partitions that are slideably engaged with the pair of groves positioned opposite each other. The other earring structure comprises at least one protrusion affixed to facing surfaces of at least one side of the frame with a cross-section that is small enough to allow hooks from hook earrings to be hung from them. The necklace structure for suspending necklaces in a tangle-free and scratch-free manner comprises a plurality of short protrusions extending upward from the top-side of the frame bottom.

As used herein:

"Displaying" or "Display-mode" means the jewelry is easily seen by a person looking for particular pieces, either as suspended, in compartments, or within box compartments.

"Scratch-free manner" means the placement of items of jewelry in relatively stationary isolation including placing rings within compressive slits, hanging necklaces and bracelets, and fixing earrings in isolation from each other.

"Tangle-free manner" means suspending individually from protrusions all pieces of tangle-prone types of jewelry such as, for example, necklaces.

My invention has several advantages over existing jewelry storage devices. First it allows the visible storage of a large amount of varied pieces of jewelry including rings. Second, the jewelry is affixed in a manner that greatly decreases the chance of pieces becoming tangled or scratched. Third, the large capacity of some embodiments of my apparatus conserves space for the storage of jewelry at a time when the trend is to acquire numerous varied pieces of jewelry for many different outfits of clothing. While other jewelry storage devices may have some of these features, my invention provides all of them. This combination has not been taught or suggested by other devices.

BRIEF DESCRIPTION OF THE DRAWINGS

One or more embodiments of the invention are described in the accompanying drawings. The drawings are briefly described below.

DETAILED DESCRIPTION OF SOME EMBODIMENTS OF THE INVENTION

Figure 1:
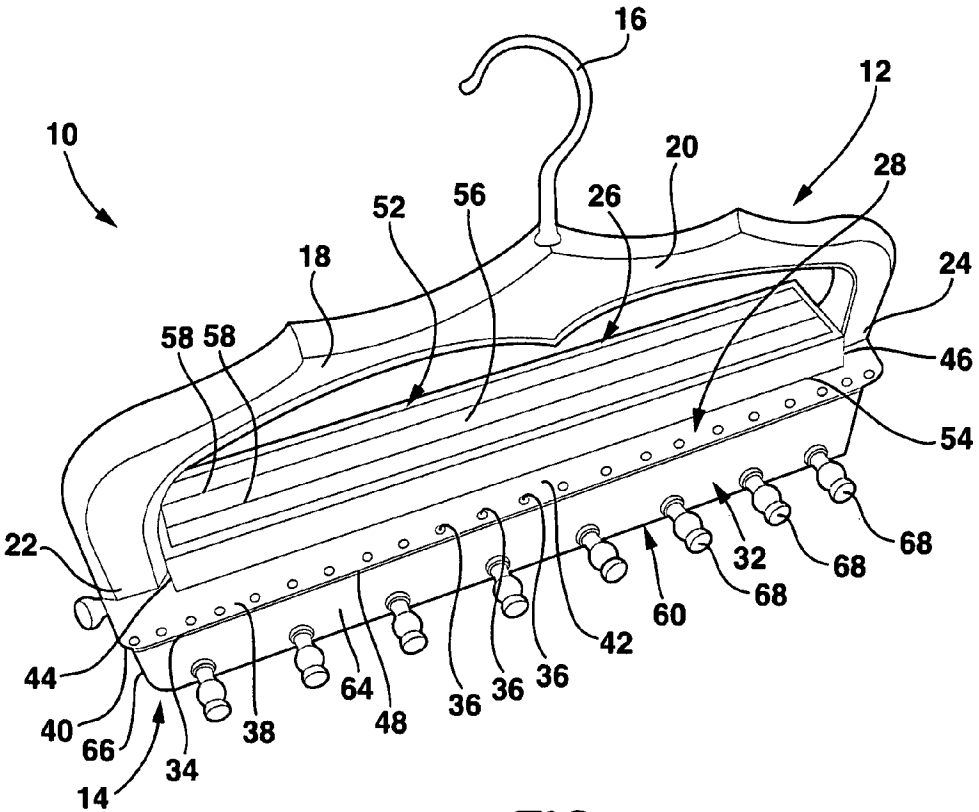
FIG. 1 is a perspective view of an apparatus of the invention from an upper central point of view.

The apparatus aspect of my invention is a jewelry storage apparatus that combines the advantages of a traditional jewelry storage box with a hanger utilizing vertical space in the closet. The apparatus is a storage means that allows one to visually display a variety of types of jewelry in a manner that prevents the pieces of jewelry from becoming tangled or scratched.

Jewelry storage boxes have been used for many years to store jewelry. They generally have multiple compartments suitable for storing a variety of types of jewelry such as, for example, rings, earrings, necklaces, and bracelets. In addition, some have compartments that have compressive slits specifically designed to hold the rings in a separate and secure manner. The major disadvantage of these jewelry boxes is that jewelry often becomes tangled and possibly scratched. Also, sets of jewelry such as, for example, earrings and necklaces become separated in various small boxes as more boxes and pieces of jewelry are acquired. Larger jewelry storage boxes sometimes have pegs to allow for the vertical hanging of necklaces to keep them tangle-free. However, large jewelry storage boxes consume a significant amount of space on floors or table tops, i.e., have an undesirably large footprint.

Recently the problems are increasing as people buying more jewelry to more individually coordinate jewelry with clothing outfits. Also, in addition to the problems of tangled pieces and undesirably large footprints, a new need has arisen. The increased amount of jewelry has created a desire to store jewelry in a visible manner to allow for more timely selections of particular pieces for a particular outfit.

Over the years, various types of hanging jewelry storage devices have been disclosed to address the growing footprint and tangling issues. While these devices address the problems of tangles necklaces and large footprint, they do not provide some of the advantages of boxes. The hanging devices have not been as able to store as much variety of jewelry as boxes have been. In particular, none of the hanging devices have compressed slits, available in some jewelry boxes, for storing rings so they will not become scratched. Also, none of the hanging devices provided the ability to store the quantity and variety of jewelry pieces often desired to be stored today. Thus, sets of rings, bracelets, earrings and necklaces for various outfits are difficult to find or assemble.

There is still an increasing need for a jewelry organizer which holds large amounts of a wide array of different types of jewelry in a limited space, keeping all pieces tangle free while displaying them in open view. My invention fills this need by combining a hanger utilizing vertical space in a closet with parts of a traditional jewelry box.

One embodiment of my invention comprises is an apparatus for storing jewelry comprising a hanger and a storage structure affixed to the hanger where the apparatus is suitable for storing in a display-mode various types of jewelry including rings, necklaces, earrings and bracelets. The hanger comprises a hook midway between two arms extending in opposite directions and angling downward, each arm having an end. The jewelry storage structure comprises four structures, a ring structure, an earring structure, a bracelet structure, and a necklace structure. The ring structure has a base and compression slits along the top for holding rings in a display mode. The bracelet structure allows for the suspension of bracelets in a scratch-fee manner. The earring structure permits the display of earrings in a scratch-free manner. The necklace structure allows for the hanging of necklaces in a tangle-free and scratch free manner.

Figure 2:
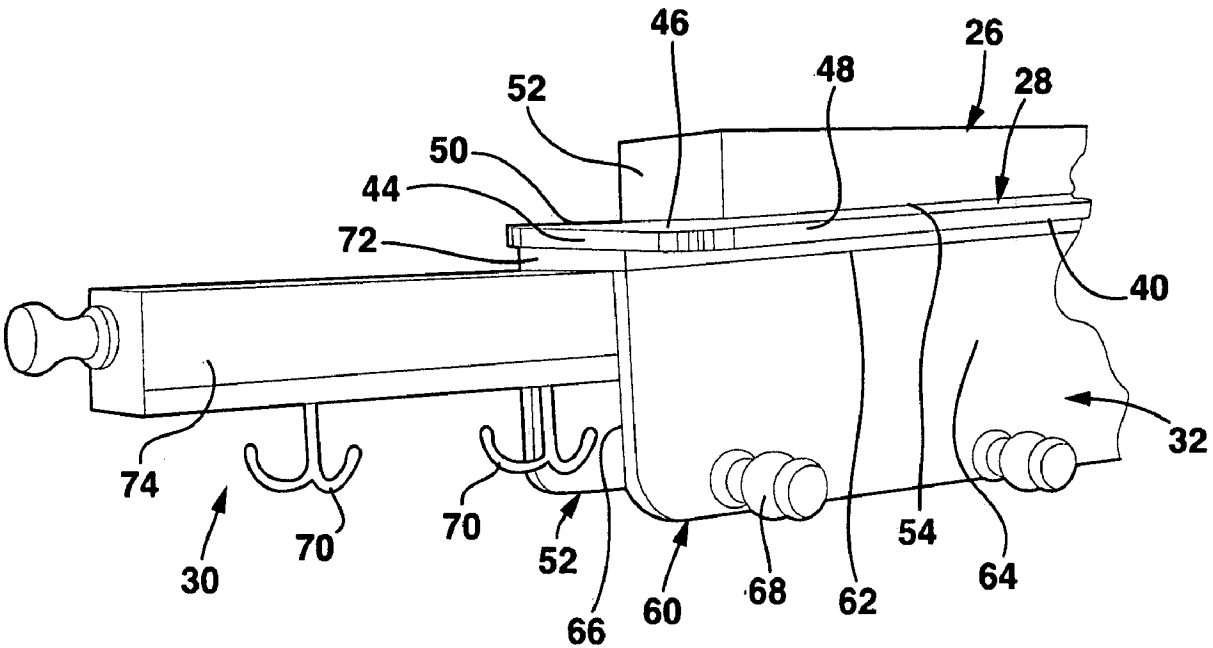
FIG. 2 is a perspective view of a jewelry storage structure without a hanger and with a drawer partially open from a slightly leftward frontal point of view.
Figure 3:
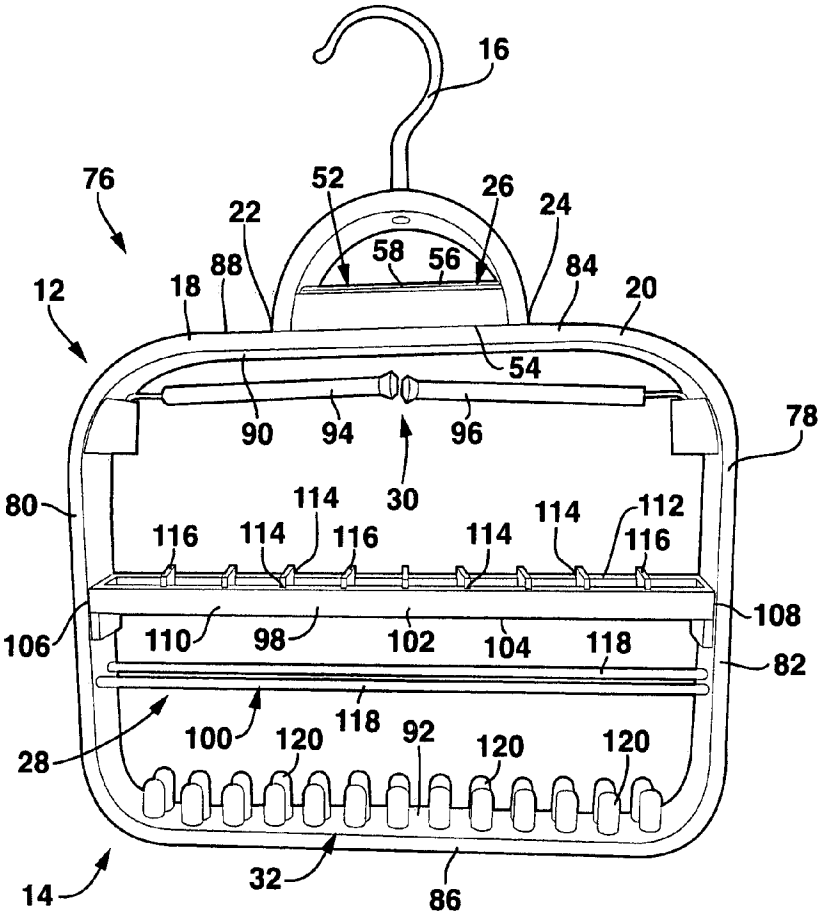
FIG. 3 is a perspective view of an apparatus of the invention from an upper frontward point of view.

Some other embodiments of the invention are illustrated in FIGS. 1-3. Elements in common are denoted with the same numbers.

FIG. 1 illustrates an embodiment of my invention for storing jewelry. An apparatus (10) is comprised of a hanger (12) and a storage structure (14) affixed to the hanger where the apparatus is suitable for storing in a display-mode various types of jewelry including rings, necklaces, earrings and bracelets. Hanger 10 includes a hook (16) midway between two arms (18, 20) that extend in opposite directions and angle downward, each arm having an end (22, 24). The hook is of a shape sufficient to hang the apparatus on a closet clothing pole and should be made of a material that is strong enough to support the apparatus when loaded with pieces of jewelry. Suitable materials are well known to the art and include metal, wood and plastic. The arms are of a shape and material suitable to attach the hook to the jewelry structure and support the jewelry storage apparatus when loaded with jewelry. Suitable shapes and materials are well known to the art and suitable materials include metal, wood and plastic. The embodiment in FIG. 1 illustrates arms that are also suitable to support conventional clothing although that shape is not required for all embodiments.

Jewelry storage structure 14 is affixed to each hanger arm end 22, 24 and comprises a ring structure (26), an earring structure (28), a bracelet structure (30) and a necklace structure (32) that are attached to each other to form one jewelry storage structure 14.

Earring structure 28 comprises a horizontal sheet (34) with holes (36) suitable for affixing earrings. The horizontal sheet also has a top (38), a bottom (32), an elongated center section (40), two short ends (42, 44) and two long ends (46, 48), wherein top 38 of the horizontal surface along short ends 42, 44 is affixed to arm ends 22, 24 and the horizontal surface near long ends 46, 48 has vertical holes 36 offset from the edges. Earrings with posts are able to be inserted through holes 36 so that caps can be put over the tips of the protruding posts. Holes near the long ends 46, 48 are also suitable for storing hook earrings where the hook ends are able to be inserted into the holes and the hook shape are able to drape around the horizontal sheet long ends. Preferably horizontal sheet 34 has a vertical thickness suitable for clip-on earrings to be affixed thereto. Materials that are suitable include, for example, wood, plastic and metal.

Ring structure 26 includes an elongated container (52). The elongated container has a bottom surface (54) that is attached to the top of the elongated center section of the horizontal sheet and a top surface (56) with at least one slit (58) suitable for compressively holding at least one ring. Apparatus 10 shows two long slits suitable for holding many rings. Top surface 56 is made of a material that is suitable to form slits able to expand to allow a ring to enter but be stiff enough to hold the ring in substantially a stable position. Materials able to do this are well known to the art and include, for example, soft wood like balsa, both open and closed cell foam, cardboard, and harder materials. The materials may be further covered in cloth such as, for example, velvet or cotton. The rest of the container needs to be made of material that provides sufficient support to maintain the shape of the container. Suitable materials include, for example, wood, plastic, metal, and even cardboard.

Necklace structure 32 comprises at least one vertical sheet (60). Vertical sheet 60 is suspended from the structure below the bottom of the elongated center section of the horizontal sheet. The sheet has a top (62), a first side (64) and a second side (66), and at least one post (68) extending outward from at least first side 64 of the vertical sheet that is suitable for holding a necklace in an untangled substantially vertical orientation. Some embodiments may have posts extending outward from both sides. Other embodiments, like the one shown in FIG. 1, have two sheets parallel to each other with posts extending outward from each sheet. Posts 68 typically are configured to retain the necklaces by means of ridges or contours, or extending slightly upward. Sheet 60 and post 68 may be made of the same or different materials as long as sufficient support is achieved. Suitable materials include, for example, wood, plastic and metal.

Bracelet structure 30 includes at least one hook (70) as shown in FIG. 2. The hook is suspended downward from beneath the bottom of the elongated center section of the horizontal sheet and configured to be able to support the hanging of a bracelet. Some embodiments do not have hooks but make use of posts extending upward from vertical rods hanging from the center section of the horizontal sheet to suspend bracelets. Hooks may be double as illustrated in FIG. 2, single, or some other combination. They may be of any material able to provide sufficient support. Suitable materials include, for example, metal, wood, and plastic. Some embodiments have hooks attached to the horizontal sheet. Some embodiments have hooks attached to additional structures that are attached to the bottom of the horizontal sheet Other embodiments also include a means for supporting a drawer and a pull-out drawer. These embodiments also often have two vertical sheets. The means may be any that are known to support a drawer including something as simple as horizontal rails affixed to the inside surfaces of the vertical sheets to a more complete enclosure that encircles the space where a drawer is slideably engaged. The means as illustrated in FIG. 2 (72) includes guide rails (not shown) affixed to the insides of two vertical sheets 60 and a horizontal bracing member attached to bottom 40 and the inside of vertical sheets 60. A drawer (74) is slideably engaged within the means. The drawer is useful for storing items that are not desired to be on visual display or for large bracelets, hook earrings, broaches or pins. Materials used for means 72 and drawer 74 may be the same or different as long as they provide sufficient support to function as intended. Suitable materials include, for example, metal, plastid and wood. Embodiments having a means for support and a drawer may also have hooks 70 attached to the bottom of the drawer, where the bottom is exposed, or the bottom of the supporting means where it encloses the drawer. The former is illustrated in the embodiment of FIG. 2.

Another embodiment is illustrated in FIG. 3. This apparatus (76) also contains hook 12, two arms 18, 20 where each have ends 22, 24, and jewelry storage structure 14. In apparatus 76, jewelry structure 14 comprises ring structure 26, earring structure 28, bracelet structure 30, and necklace structure 32. However, apparatus 10 also comprises a frame (78) to which each of the jewelry structures are attached.

Frame 78 includes two sides (80, 82), a top (84) and a bottom (86). Frame top 84 has a top-side (88) and an underside (90) and frame bottom has a top-side (92). The frame in FIG. 2 has a height of about 15 inches, a width of about 15 inches and a depth of about 2 inches. The dimensions of other embodiments may vary as long as the apparatus is able to fit in a typical closet and hang from a closet pole in a similar manner to clothes on a hanger or from a hook in a wall. Suitable materials include, for example, metal, wood, and plastic.

Ring structure 26 is constructed in a similar manner to that shown in FIG. 1 with elongated container 52, bottom surface 54, top surface 56 and at least one compression slit 58 in the top surface to hold rings. Bottom surface 54 is affixed to frame's top-side surface 88. Other embodiments may have a container that is more elongated and the hanger arms longer and extend further apart from each other than the embodiment illustrated in FIG. 3. Still other embodiments may have a container that is less elongated and the frame is deeper than the embodiment illustrated in FIG. 3.

Bracelet structure 30 comprises protrusions (94, 96) extending from each side 80, 82 of frame 78 for holding bracelets in a scratch-free manner. Protrusions 94, 96 in FIG. 3 are illustrated as rods that are pivotally attached to frame sides 80, 82. Other embodiments may have protrusions that are of different elongated shapes as long as bracelets are able to be passed over them for suspension. Still other embodiments may have protrusions that are affixed to the frame sides without the ability to pivot. Also, other embodiments hay have only one protrusion extending from only one frame side as long as there is enough gap between the unattached end and the other frame side to allow a bracelet to be placed in a suspended fashion onto the protrusion. The protrusions may be made of wood, plastic, or metal.

Earring structure 28 for apparatus 76 comprises two structures, a post earring structure (98) and a hook earring structure (100). Post earring structure 98 is comprised of a box (102) that includes a base (104), two ends (106, 108) where each end is affixed to a frame side 80, 82, and two sides (110, 112). Each side has grooves (114) perpendicular to the base parallel to each other and aligned with matching grooves in the facing surface of the other side. A plurality of removable and repositionable panels (116) are slideably attached to the sides through the matching grooves to form adjustable compartments able to hold post earrings of various sizes. The compartments may also be used to hold other pieces of jewelry such as, for example, pins, broaches and clip-on earrings in a scratch-free display manner. Suitable materials include, for example, wood, plastic and metal.

Hook earring structure 100 comprises approximately horizontally protrusions (118) that are affixed to facing frame sides 80, 82. Apparatus 76 shows two protrusions. Other embodiments may have one or more than two. While apparatus 76 shows smooth rods as protrusions, they may be of any shape or contour that permits hook earrings to be hung from them. The diameter of the protrusions in some embodiments may range from that of a thin suspended wire to over one half (½) of an inch as long as hooks are able to be hung from them. Suitable materials include, for example, wood, plastic and metal.

Necklace structure 32 comprises a plurality of short protrusions (120) affixed to top-side 92 of frame bottom and extending upward from frame bottom 86. For apparatus 76, short protrusions 120 are similar to posts 68 of apparatus 10. The short protrusions typically are configured to retain the necklaces by means of ridges or contours, or extending upward from frame bottom 86 in angles ranging from slightly above horizontal to fully perpendicular. In some embodiments the protrusions are cylindrical in shape. In other embodiments the protrusions have other shapes such as, for example, pyramids, to solid rectangles, and others that are able to have necklaces hung from them in a tangle-free and scratch-free manner. In still other embodiments, the frame has no bottom and the necklace structure comprises a horizontal member extending between facing sides of the frame and a plurality of protrusions extending upward from the horizontal member.

Other embodiments will be apparent to those skilled in the art. Some embodiments may have the elements in different arrangements. For example, the elongated box may be affixed to the side of one of two vertical sheets. Some embodiments may be made predominately of wood while others may be predominately of plastic. This document is meant to include all embodiments that encompass the spirit and purpose of the invention and include the required elements.

I claim:

1. A jewelry storage apparatus, comprising, a hanger, comprising, a hook midway between two arms extending in opposite directions and angling downward, each arm having an end and a jewelry storage structure affixed to the hanger and suitable for storing and displaying jewelry in a tangle-free and scratch-free manner, comprising, an earring structure for displaying earrings in a scratch-free manner comprising a horizontal sheet having a top, a bottom, an elongated center section, two short ends and two long ends, wherein the top of the horizontal surface along the short ends is affixed to the arm ends and the horizontal surface near the long ends has vertical holes of a size suitable for affixing pierced earrings, the ring structure with compression slits for holding rings in a display mode comprising an elongated container having a bottom surface affixed to the top of the elongated center section of the horizontal sheet and a top surface with at least one slit suitable for compression holding at least one ring, the necklace structure for suspending necklaces in a tangle-free and scratch-free manner comprising at least one vertical sheet suspended from the structure below the bottom of the elongated center section of the horizontal sheet, the vertical sheet having a top, a first side and a second side, and at least one post extending outward from at least the first side of the vertical sheet suitable for holding a necklace in an untangled orientation, and a bracelet structure for suspending bracelets in a scratch free manner.

2. The apparatus of claim 1 wherein the horizontal sheet of the earring structure has a vertical thickness suitable for clip-on earrings to be affixed thereto.

3. The jewelry storage structure of claim 1 wherein the bracelet structure comprises at least one hook suspended downward from beneath the bottom of the elongated center section of the horizontal sheet and configured to be able to support the hanging of a bracelet.

4. The jewelry storage structure of claim 1 wherein the necklace structure further comprises a second vertical sheet substantially parallel to the first vertical sheet and suspended from the structure below the bottom of the elongated center section of the horizontal sheet, the vertical sheet having a top, a first side and a second side, and at least one post extending outward from at least the first side of the vertical sheet suitable for holding a necklace in an untangled orientation.

5. The jewelry storage structure of claim 4, further comprising, means for supporting a drawer where means is horizontally-affixed to the second sides of each vertical sheet, and a pull-out storage drawer having a bottom, aligned below the bottom elongated center section of the horizontal sheet, slideably engaged to the support means and suitably sized for storing broaches, hook earrings, and pins.

6. The jewelry storage structure of claim 5 wherein the bracelet structure comprises at least one hook suspended downward from the bottom of the drawer and configured to be able to support the hanging of a bracelet.

7. The apparatus of claim 1 wherein the jewelry storage structure is substantially composed of wood.

8. The apparatus of claim 1 wherein the jewelry storage structure is substantially composed of wood.

9. A jewelry storage apparatus, comprising, a hanger, comprising, a hook midway between two arms extending in opposite directions and angling downward, each arm having an end and a jewelry storage structure affixed to the hanger and suitable for storing and displaying jewelry in a tangle-free and scratch-free manner, comprising, a frame that has opposing sides and facing sides, a top, and a bottom, the frame top has a top-side and an under-side, the frame bottom has a top-side, a ring structure with compression slits for holding rings in a display mode having a bottom that is fastened to the top-side of the frame, a bracelet structure for suspending bracelets in a scratch free manner comprising a protrusion extending from only one facing side of the frame and pivotally attaching to the side of the frame, an earring structure for displaying earrings in a scratch-free manner, and a necklace structure for suspending necklaces in a tangle-free and scratch-free manner.

10. The apparatus of claim 9 wherein the bracelet structure comprises a protrusion extending from each facing side of the frame.

11. The apparatus of claim 9 wherein the earring structure comprises a box, comprising, a base, two ends where each end is affixed to a facing side of the frame, two sides where each side has groves perpendicular to the base, parallel to each other, in the surfaces of the sides that face each other, and paired so that each grove from one side is opposite a matching groove from the other side, and a plurality of removable, repositionable partitions that are slideably engaged with the pair of groves positioned opposite each other and able to form adjustably-sized compartments.

12. The apparatus of claim 11 wherein the earring box is removable from the frame.

13. The apparatus of claim 9 wherein the earring structure, comprises, at least one protrusion affixed to at least one facing surface of each side of the frame with a cross-section that is small enough to allow the hooks from hook earrings to be hung from them.

14. The apparatus of claim 9 wherein the necklace structure, comprises, a horizontal member affixed to facing surfaces of each side of the frame and a plurality of protrusions extending upward from the horizontal member.

15. A jewelry storage apparatus, comprising, a hanger comprising a hook midway between two arms extending in opposite directions and angling downward, each arm having an end and a jewelry storage structure for storing and displaying jewelry in a tangle-free and scratch-free manner, comprising, a frame that has two sides, a top, and a bottom, the frame top has a top-side and an under-side, the frame bottom has a top-side, and the top side of the frame is affixed to each end of the hanger arms;

a ring structure that comprises a bottom surface and a top surface where the bottom surface of the ring structure is fastened to the top-side of the frame top and compression slits for holding rings in a display mode are positioned along the top surface of the ring structure;

a bracelet structure for suspending bracelets in a scratch free manner, the bracelet structure comprising a protrusion pivotally connected to and extending from at least one facing side of the frame;

an earring structure for displaying earrings in a scratch-free manner, comprising, a box, comprising, a base, two ends where each end is affixed to a side of the frame, two sides where each side has groves perpendicular to the base, parallel to each other, in the surfaces of the sides that face each other, and paired so that each grove from one side is opposite a matching groove from the other side, and a plurality of removable, repositionable partitions that are slideably engaged with the pair of groves positioned opposite each other, and at least one protrusion affixed to facing surfaces of each side of the frame with a cross-section that is small enough to allow the hooks from hook earrings to be hung from them; and a necklace structure for suspending necklaces in a tangle-free and scratch-free manner, comprising, a plurality of protrusions affixed to the top-side of the bottom of the frame and extending upward from that top-side.

16. The apparatus of claim 15 wherein the bracelet structure is removable.

17. The apparatus of claim 15 wherein the jewelry storage structure is substantially composed of wood.

* * * * *